United States Patent [19]

Engelhardt et al.

[11] Patent Number: 5,061,098

[45] Date of Patent: Oct. 29, 1991

[54] PRINTER STATION WITH OUTPUT DISCHARGING DEVICE FOR INDIVIDUAL SHEETS

[75] Inventors: Günther Engelhardt, Niederstotzingen; Gerhard Lohrmann, Thalfingen; Helmut Riesenegger, Elchingen, all of Fed. Rep. of Germany

[73] Assignee: Mannesmann Aktiengesellschaft, Düsseldorf, Fed. Rep. of Germany

[21] Appl. No.: 384,736

[22] Filed: Jul. 21, 1989

[51] Int. Cl.[5] ..... B41J 13/03

[52] U.S. Cl. ..... 400/625; 271/213; 271/224; 400/578

[58] Field of Search ..... 400/625, 636, 578, 645, 400/647, 647.1; 271/207, 213, 224; 355/321, 323

[56] References Cited

U.S. PATENT DOCUMENTS

| | | | |
|---|---|---|---|
| 2,731,125 | 1/1956 | Hasalmeier | 400/578 |
| 4,371,276 | 2/1983 | Mitrovich et al. | 400/625 |
| 4,865,305 | 9/1989 | Momiyama et al. | 400/625 |

FOREIGN PATENT DOCUMENTS

| | | | |
|---|---|---|---|
| 0129769 | 8/1982 | Japan | 400/625 |

*Primary Examiner*—Edgar S. Burr
*Assistant Examiner*—Christopher A. Bennett
*Attorney, Agent, or Firm*—Horst M. Kasper

[57] ABSTRACT

A printer station (1) with output discharging device (3) for individual sheets (6) is in particular used for laser page printers. An outwardly directed output discharging device (3) follows to output roller pairs (5), as seen in transport direction (7) of the printed individual sheets (6). In order to dispose the output discharging device (3) in a space-saving fashion, and in order to create the possibility for the operator to adjust the output discharging device (3) to the local special situation, the output discharging device (3) is tiltably supported at the printer frame (4) of the printer station (1), where the output discharging device (3) is furnished with drivable friction roller pairs (13), disposed behind the output roller pairs (5), as seen in transport direction (7). The shafts (14, 15) of the friction roller pairs (13) are in each case rotatably supported at the side walls (8,9) of the tiltable output discharging device (3).

25 Claims, 4 Drawing Sheets

PRINTER STATION WITH OUTPUT DISCHARGING DEVICE FOR INDIVIDUAL SHEETS

BACKGROUND OF THE INVENTION

1. Field of the Invention

The invention relates to a printer station with an output discharging device for individual sheets, in particular for laser page-printers, or the like, where there is provided an outwardly directed output discharging device which follows to output roller pairs in the direction of advance of the printed individual sheets.

2. Brief Description of the Background of the Invention Including Prior Art

The output discharging devices of laser printers and other printers are rigidly attached to a printer frame and are aligned either horizontally or inclined at a certain angle relative to a horizontal plane. These devices are also known to have several pigeon holes or output paper trays with adjustable height-level distances for sorting, where the angle, relative to a horizontal, can be adjusted within small limits. All these devices are associated with the disadvantage of being bulky and space-consuming. Such a placing system for the output paper interferes with other office devices, for example, drawers, doors, or the like, disposed beneath a table top.

SUMMARY OF THE INVENTION

1. Purposes of the Invention

It is an object of the present invention to provide a space-saving output device for a printer station.

It is yet another object of the invention to create the possibility of adjusting and adapting the output device to the special local conditions of the positioning of the printer station.

It is yet a further object of the present invention to furnish an adjustment system for positioning multiple discharging devices of output paper collectors.

These and other objects and advantages of the present invention will become evident from the description which follows.

2. Brief Description of the Invention

The present invention provides for a printer station comprising a printer frame of the printer station. Output roller pairs have each a roller shaft and are mounted to the printer frame. A tiltable output discharging device for individual sheets or the like has a left side wall and a right side wall and is rotatably supported at the printer frame of the printer station. The output discharging device is furnished with drivable friction roller pairs with friction shafts and is disposed, if viewed in a direction of advance of the printed individual sheets, after the output roller pairs. The friction roller shafts of the friction roller pairs, in each case, are rotatably supported at the side walls of the tiltable output discharging device. The output discharging device is disposed outwardly directed and after the output roller pairs if viewed in a direction of advance of the printed individual sheets.

The printer can be a laser page printer or a non-impact page printer.

A first gear wheel can be disposed on the roller shaft of the output roller pairs. A gear train can engage the first gear wheel. The friction roller shafts of the friction roller pairs can be driven the gear wheel connected to the roller shaft of the output roller pairs.

A left bearing pin can be furnished at the left side wall. A right bearing pin can be furnished at the right side wall. The left bearing pin and the right bearing pin can form a first pivoting axis. A left lever-like bearing rocker can be coordinated to the left side wall and can include a left opening for a link rod. A right lever-like bearing rocker can be coordinated to the right side wall and can include a right opening for a link rod. A floor piece can form part of the output discharging device such that the output discharging device can include the left side wall, the right side wall, and the floor piece joined together. The friction roller shafts, supporting the friction roller pairs, can be rotatably supported via the left lever-like bearing rocker and via the right lever-like bearing rocker. One of the friction shafts can be supported relative to the left side wall via the left bearing rocker shaft in the left opening and via the right bearing rocker shaft in the right opening. The bearing rockers can be rotatably supported around a second pivoting axis.

The first pivoting axis is spaced apart from the second pivoting axis by a distance which is about 0.5 to 0.8 times the distance between the centers of the friction roller shafts from each other.

Exchangeable output paper collecting trays can be positioned into the output discharging device. Snap means can lockingly engage the output paper trays in the left side wall and in the right side wall.

A catch gear wheel can have counter locking teeth. The catch gear wheel can be rotatably attached on the first pivoting axis. The side walls can be pivotable around the first pivoting axis. A spring-supported catch can have locking teeth for fixing a position and can be rotatably supported at the printer frame for furnishing different tilting positions of the output discharging device. The locking teeth of the spring-supported catch can be cooperating with the counter locking teeth of the catch gear wheel.

A collection method for sheet output comprises the following steps. A tiltable output discharging device for individual sheets or the like is tilted. The output discharging device has a left side wall and a right side wall, and is rotatably supported at the printer frame of the printer station in a desired position. The paper sheets are further gripped and rotatingly engaged with drivable friction roller pairs of the output discharging device with friction shafts. Said friction rollers are disposed, as seen in advance direction of printed individual sheets, following to the output roller pairs. The friction shafts of the friction roller pairs, in each case, are rotatably supported at the side walls of the tiltable output discharging device. The output discharging device is disposed outwardly directed and following to output roller pairs as seen in transport direction of printed individual sheets. Paper sheets are discharged with output roller pairs, each having a roller shaft and mounted to the printer frame of the printer station.

A first gear wheel, disposed on the roller shaft of the output friction rollers, can be engaged with a driven gear train. The friction roller shafts of the friction roller pairs can be connected to the gear wheel on the roller shaft of the output roller pairs.

A left bearing pin can be furnished at the left side wall. A right bearing pin can be furnished at the right side wall. The left bearing pin and the right bearing pin can form a first pivoting axis. A left lever-like bearing rocker can be coordinated to the left side wall and can include a left opening for a link rod. A right lever-like bearing rocker can be coordinated to the right side wall and can include a right opening for a link rod. A floor piece can form part of the output discharging device such that the output discharging device can include the left side wall, the right side wall, and the floor piece joined together. The friction shafts, supporting the friction roller pairs, can be rotatably supported via the left lever-like bearing rocker and via the right lever-like bearing rocker. One of the friction shafts can be supported relative to the left side wall via the left bearing rocker shaft in the left opening and via the right bearing rocker shaft in the right opening. The bearing rockers can be tilted around a second pivoting axis. The exchangeable output paper collecting trays can be positioned in the output discharging device. The output paper trays can lockingly engage in the left side wall and in the right side wall with snap connections.

The side walls can pivot around a first pivoting axis. A catch gear wheel, having counter locking teeth, can be rotatably attached on the first pivoting axis. A position can be fixed with a spring-supported catch, having locking teeth rotatably supported at the printer frame, for furnishing different tilting positions of the output discharging device. The locking teeth of the spring-supported catch can be cooperating with the counter locking teeth of a catch gear wheel.

According to the invention, the output discharging device is pivotably supported at the printer frame of the printer station. The output and discharging device is furnished with drivable friction roller pairs, disposed behind the output roller pairs, as seen in the transport direction. The shafts of the friction roller pairs are respectively rotatably supported at the side walls of the pivotable output discharging device. It is possible with this printing station that the output discharging device, depending on the local situation, can be set tilted upwardly or downwardly. In this way, substantial space savings can be achieved, and items disposed below the printer station, such as drawers, doors, or the like, are as easily accessible as prior to the installation.

According to another aspect of the invention, the shaft of the friction roller pairs are connected via a drive train to a gear wheel on a shaft of the output roller pairs. In this way, a separate drive motor for the friction roller pairs can be dispensed with.

According to a further improvement of the invention, it is disclosed that the output discharging device is formed by a left side wall, a right side wall, and a floor piece, where bearing pins are provided at the side walls. The bearing pins form a first pivoting axis. The shafts, supporting the friction roller pairs, are rotatably supported by way of lever-like bearing rockers, disposed at and coordinated to the side walls. One of the shafts is, in each case, supported via a bearing-rocker shaft in an opening for a connecting link in the respective side wall. The bearing rockers are rotatably supported around a second pivoting axis. The principle of the first pivoting axis and of the second pivoting axis allows a larger tilting region of the output device and a more favorable deflection and redirection of the paper. Therefore, the pivoting axes are not concentrically disposed but rather at a distance.

It is furthermore advantageous that exchangeable paper storage trays, which can be lockingly engaged in the side walls, are provided in the output discharging device. Such a construction allows the use of, for example, a job-jogger device, or else storage trays with any longitudinal dimensions can be exchanged for differing paper lengths.

According to a further feature of the invention, a spring-supported catch fixing a position can be rotatably supported at the printer frame for different tilting positions of the output discharging device. The locking catch teeth cooperate with counter locking catch teeth of a catch gear wheel. The catch gear wheel is attached on the first pivoting axis and fixed against rotation relative to the first pivoting axis. The side walls are pivotable around the first pivoting axis. These steps allow the fixing of the tilted output discharging device such that unintended contacts by the operating personnel cannot cause an undesired change of a set tilting position.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
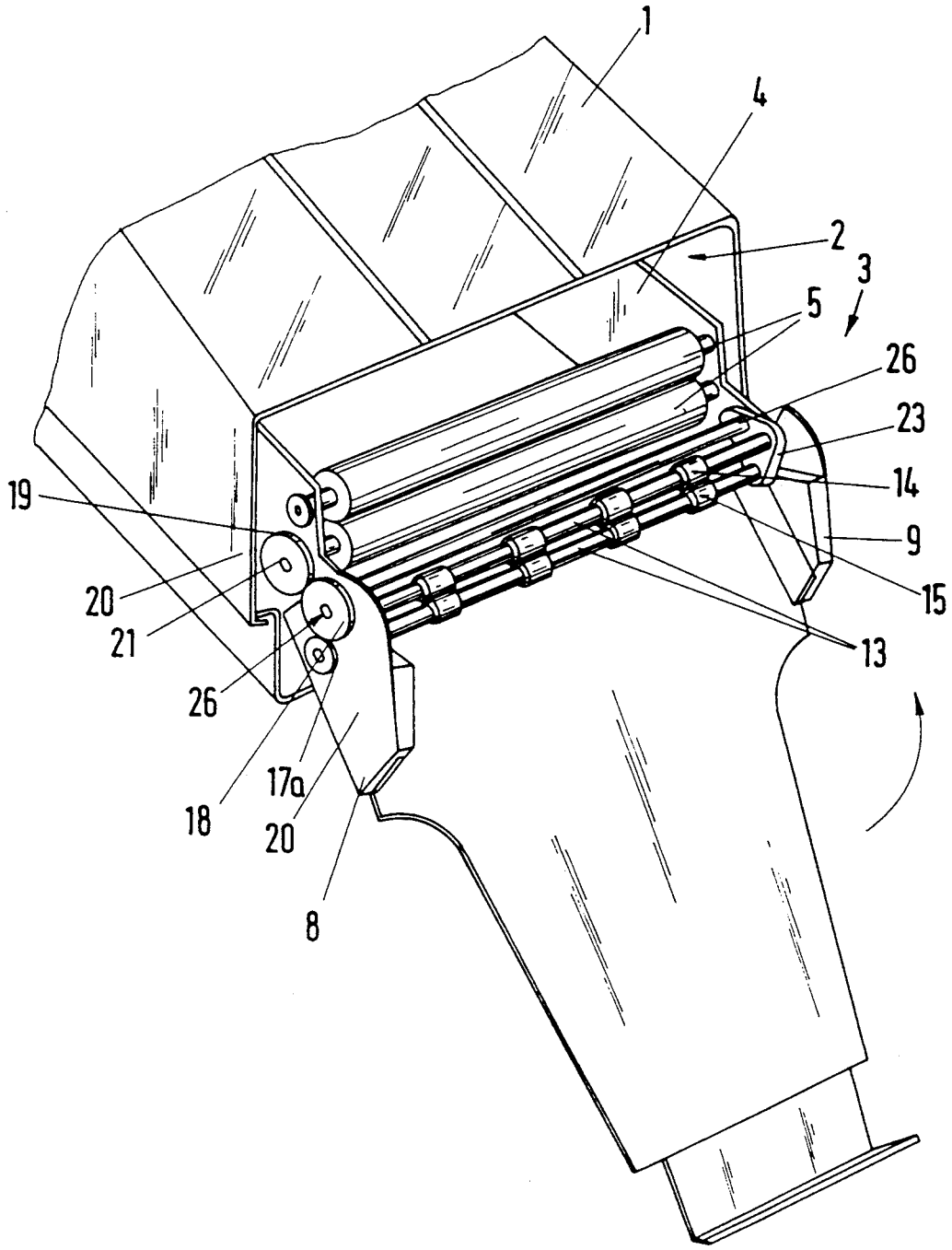
FIG. 1 is a perspective view of the general arrangement of a printer station with the output discharging device.

In accordance with the present invention, there is provided a printer station 1 with an output discharging device 3 for individual sheets 6, in particular for laser page printers, or the like. The output discharging device 3 is disposed outwardly directed and following to output roller pairs 5 as seen in transport direction 7 of printed individual sheets 6. The the output discharging device 3 is rotatably supported at the printer frame 4 of the printer station 1. The output discharging device 3 is furnished with drivable friction roller pairs 13, disposed, as seen in transport direction 7, following to the output roller pairs 5. The shafts 14, 15 of the friction roller pairs 13, in each case, are rotatably supported at side walls 8 and 9 of the tiltable output discharging device 3.

The shafts 14 and 15 of the friction roller pairs 13 can be connected to a gear wheel 19 on a shaft 21 of the output roller pairs 5 via a gear train 20.

The output discharging device 3 can include a left side wall 8, a right side wall 9, and a floor piece 10. Bearing pins 11 can be furnished at the side walls 8 and 9. The bearing pins 11 can form a first pivoting axis 12. The shafts 14, 15, can support the friction roller pairs 13. The shafts 14, 15 can be rotatably supported via lever-like bearing rockers 22, 23. The bearing rockers 22, 23 can be coordinated to the side walls 8, 9. One of the shafts 14 or 15, in each case, can be supported in a respective side wall 8 or 9 via a bearing rocker shaft 24 in an opening 25 for a link rod. The bearing rockers 22, 23 can be rotatably supported around a second pivoting axis 26.

The output discharging device 3 can be furnished with exchangeable output paper trays 10*a*. Said output paper trays 10*a* can be lockingly engaged in the side walls 8 and 9 by means of snap connections 27 forming locking means.

A spring-supported catch 28 for fixing a position can be rotatably supported at the printer frame 4 for furnishing different tilting positions of the output discharging device 3. The locking teeth 28*a* of the spring-supported catch 28 can be cooperating with the counter locking teeth 30*a* of a catch gear wheel 30. The catch gear wheel 30 can be rotatably attached on the first pivoting axis 12, around which pivoting axis 12 the side walls 8, 9 can be pivotable.

The printer station 1 comprises, for example, a laser printer, which supports at its output 2 an output discharging device 3. The output discharging device 3 is supported at the printer frame 4. An output roller pair 5 is present at the output 2. The output roller pair 5 moves the individual sheets 6 in transport direction 7. The output discharging device 3 comprises substantially a left side wall 8, a right side wall 9, and a floor piece 10 connecting the right side wall 9 and the left side wall 8. The output discharging device 3 is thus pivotably supported in the printer frame 4 via bearing pins 11 attached to the side walls 8 and 9. These two bearing pins 11 form a first pivoting axis 12, disposed horizontally under operation conditions.

Several drivable friction roller pairs 13 follow 7 to the output roller pair 5 as seen in transport direction. The friction roller pairs 13 are tiltable with the output discharging device 3. The shafts 14 and 15 are indirectly and rotatably supported at the side walls 8 and 9 of the output discharging device 3.

The shafts 14 and 15 carry gear wheels 16, 17, 17*a*, where the gear wheel 17*a* engages into an intermediate gear wheel 18, which in turn engages with a gear wheel 19. The distance of the center axes of the shafts 14, 15 can be from about 0.5 to 0.8, and preferably from 0.55 to 0.7 of the smaller one of the diameters of the output roller pair 5. The gear wheels 16, 17, 18, and 19 form a drive train 20, which is driven by a motor, not illustrated, on the shaft 21 of the output roller pair 5.

Figure 2:
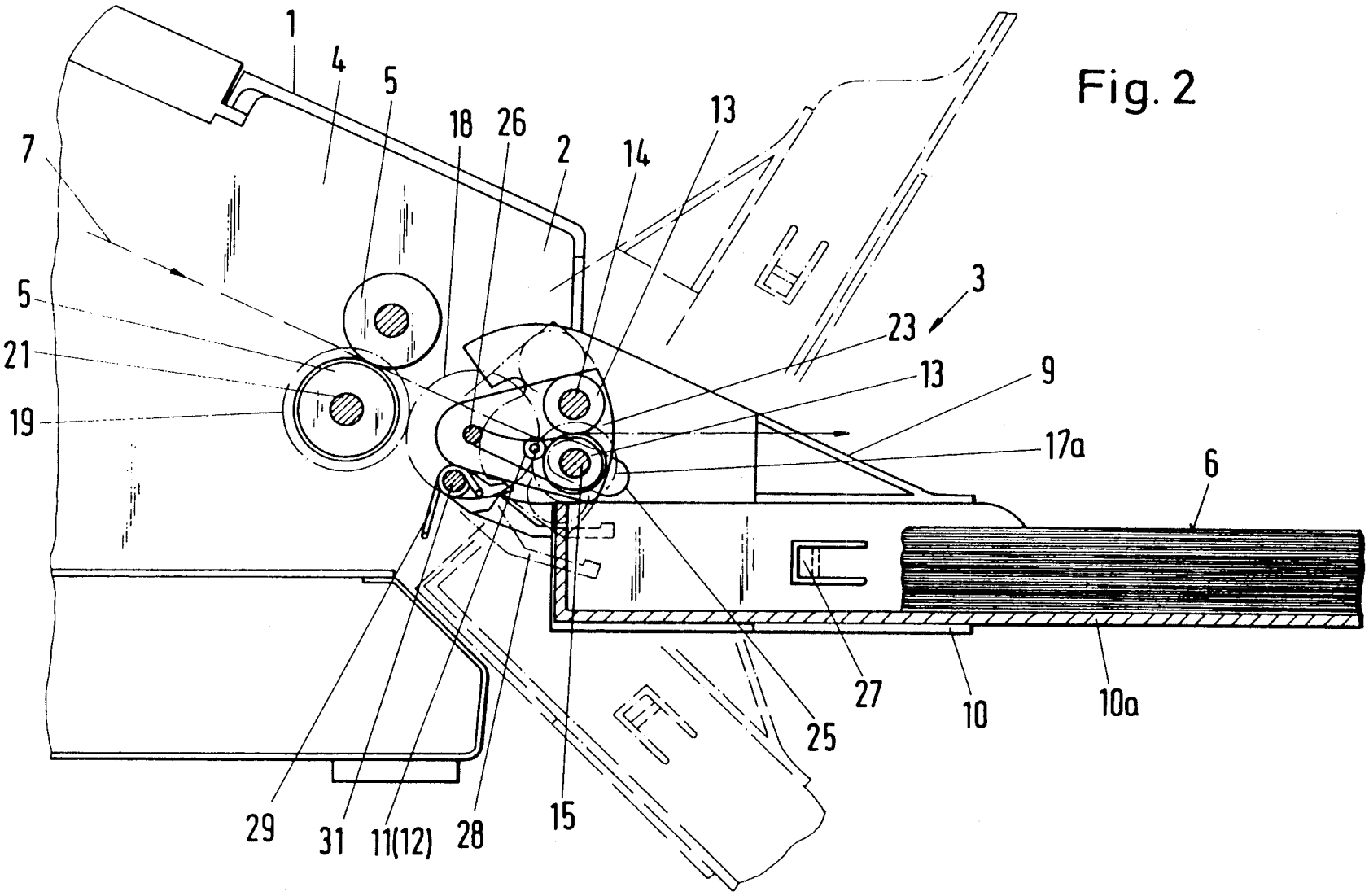
FIG. 2 is a cross-sectional view through the output section of the printer station with the output discharging device.
Figure 3:
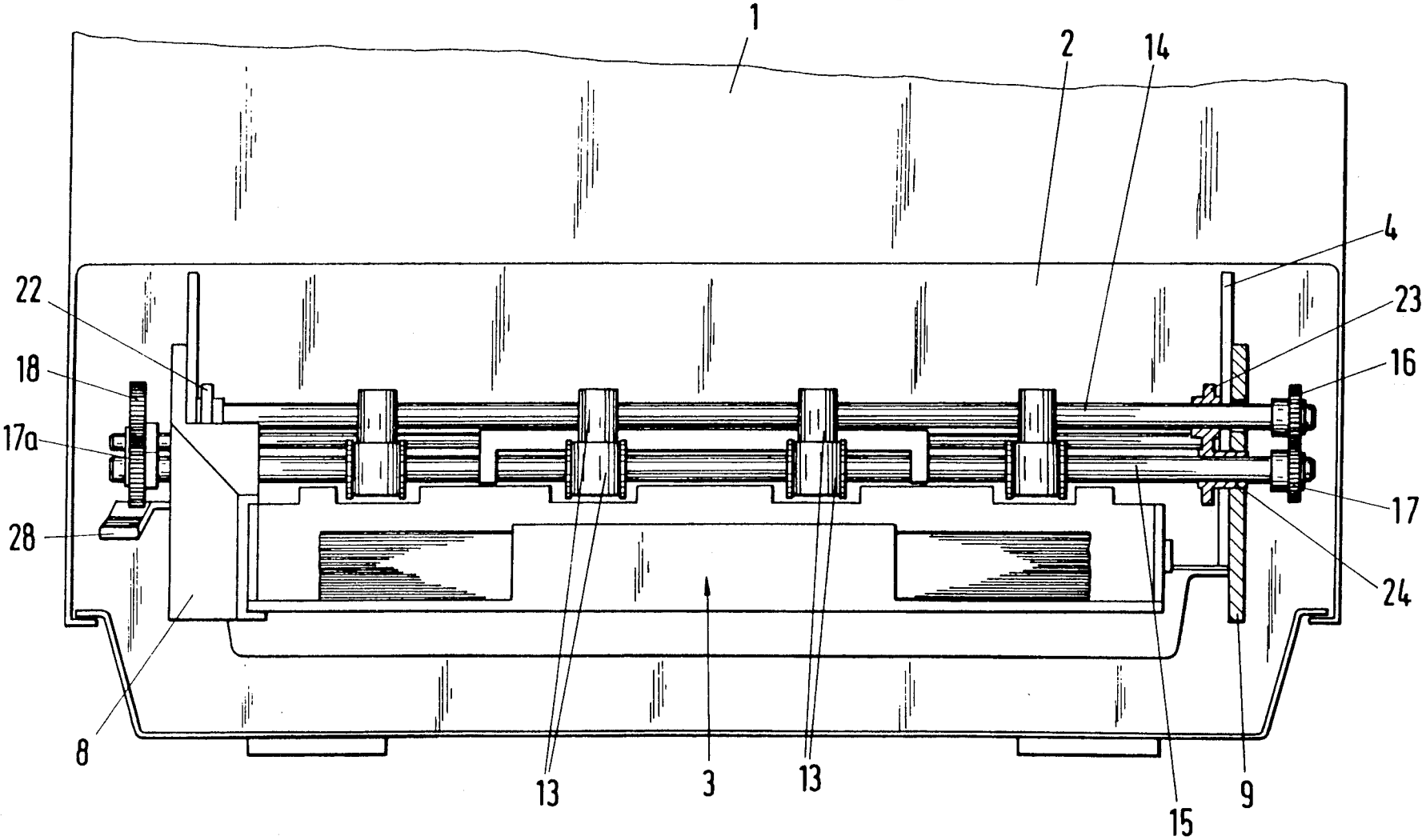
FIG. 3 is a top plan view onto the printer station with the output discharging device.

The output discharging device 3, comprising the side walls 8 and 9 and the floor piece 10, is thus rotatably supported around the first pivoting axis 12 by way of the bearing pins 11. In contrast, the shafts 14 and 15, supporting the friction roller pairs 13, are rotatably supported by way of lever-like bearing rockers 22 and 23, coordinated in each case to the side walls 8 and 9. The bearing rocker 23 engages with a bearing rocker shaft 24 into a rocker opening 25 of a connecting link. Said rocker opening 25 is in each case furnished in the side walls 8 and 9. The bearing rockers 22 and 23 are however rotatably supported around a second pivoting axis 26 in the printer frame 4. The second pivoting axis 26 is disposed at a distance in direction opposite to the transport direction 7, relative to the first pivoting axis 12 as illustrated in FIG. 2. The distance can be from about 1 to 1.5 times the distance between the first pivoting axis 12 and the center of the nearest shaft 14, 15. The distance can further be from about 0.8 to 1.2 times the distance between the centers of the shafts 14, 15 from each other. This allows to obtain in all pivoting positions of the output discharging device 3 an optimum position of the friction roller pairs 13 relative to the output roller pair 5 and in order to create the recited favorable distance for purposes of space savings.

As illustrated in FIG. 2, the output discharging device 3 can be tilted from a horizontal by 45 degrees downwardly and by up to 60 degrees upwardly.

Advantageously, exchangeable output paper trays 10*a* are provided in the output discharging device 3, which can be lockingly engaged in the side walls 8 and 9 by way of snap connections 27 and then the paper trays 10*a* can be disengaged again.

Figure 4:
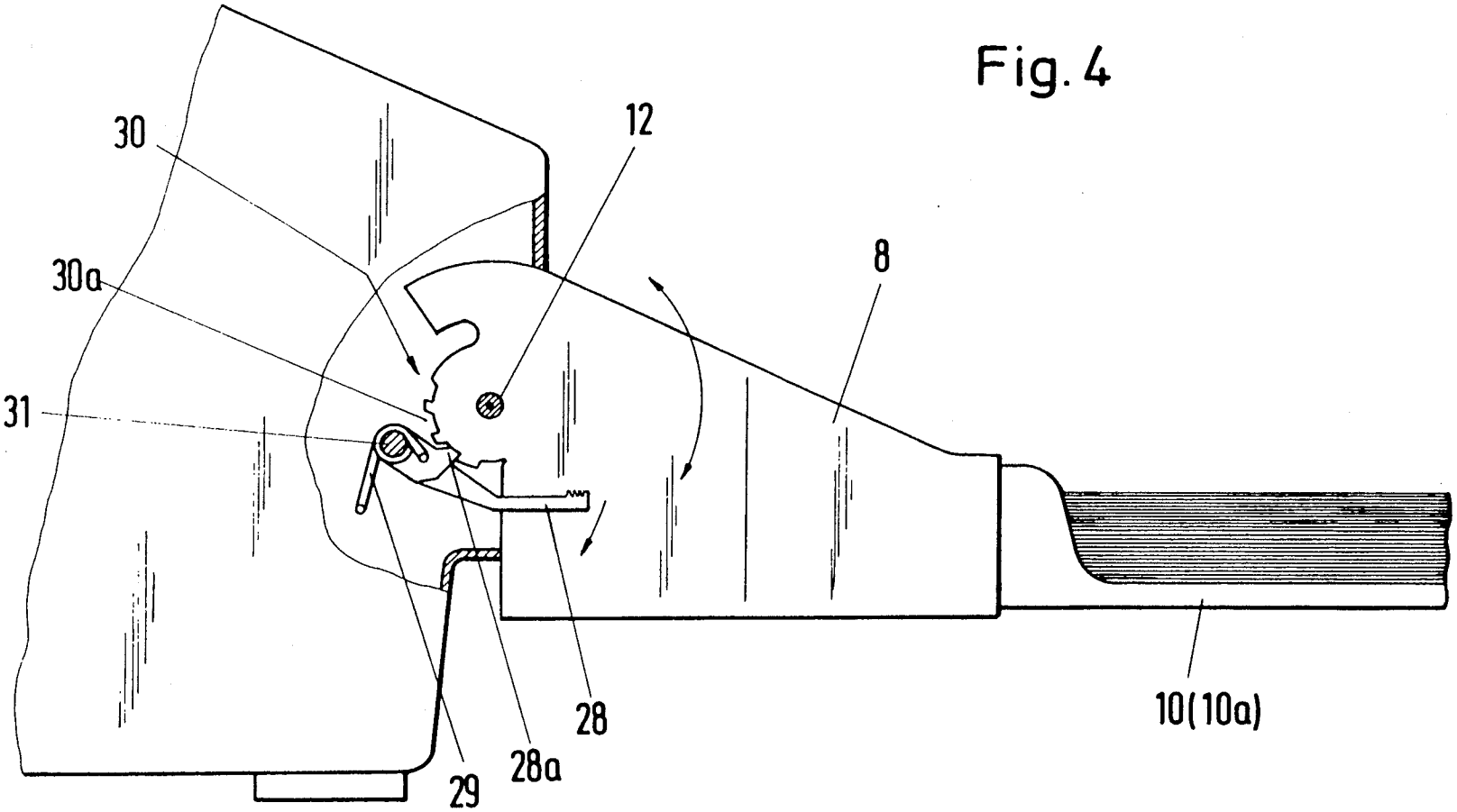
FIG. 4 is a side view with a partial section in the area of the catch gear wheel.

The tilting positions up to minus 45 degrees and up to plus 60 degrees of the output discharging device 3 are fixed by way of a spring-supported catch 28 for fixing position. The positioning catches 28 are rotatably supported at the printer frame 4 and, in addition, are loaded by a spring-exerting force via a leg spring 29. The catches 28 for fixing position further exhibit locking teeth 28*a*, which engage between the counter locking teeth 30*a* of a catch gear wheel 30. The first pivoting axis 12 can be also selected for the support of the catch gear wheel 30. Otherwise, there can be provided a separate pivoting axis 31. The catch gear wheel 30 can also be part of the side walls 8 and 9, as illustrated in FIG. 4.

The gear wheel 18 is disposed concentric with the axis 26 to allow the gear wheel 17*a* to engage the gear wheel 18 independent of the relative position of the friction roller pairs 13. The output discharge collecting tray 10*a* can be slid in between the walls 8 and 9. The connection plane between the pivoting axis 26 and the pivoting axis 12 is preferably at an angle which is disposed between the direction of the paper path and the connection between the pivoting axis 12 and the center of the lower output roller 19.

It will be understood that each of the elements described above, or two or more together, may also find a useful application in other types of printer stations differing from the types described above.

While the invention has been illustrated and described as embodied in the context of a printer station with output discharging device for individual sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A printer station comprising a printer frame of the printer station;

first roller shaft;

second roller shaft, wherein the first roller shaft and the second roller shaft forms output roller pair mounted to the printer frame;

a tiltable output discharging device for individual sheets or the like having a left side wall and a right side wall and rotatably supported at the printer frame of the printer station, and wherein the output discharging device includes a drivable friction roller pair with friction shafts and said output discharging device is disposed, if viewed in a direction of advance of printed individual sheets, after the output roller pair, where the friction roller shafts of the friction roller pair is rotatably supported on the side walls of the tiltable output discharging device, and where the output discharging device is disposed outwardly directed and after the output roller pair where said outward direction coincides with the direction of advance of printed individual sheets.

2. The printer station according to claim 1, wherein the printer is a laser page printer.

3. The printer station according to claim 1, wherein the printer is a non-impact page printer.

4. The printer station according to claim 1 further comprising a first gear wheel disposed on the roller shaft of the output roller pair;

a gear train for engaging the first gear wheel, wherein the friction roller shafts of the friction roller pair are driven by the gear wheel connected to the roller shaft of the output roller pair.

5. The printer station according to claim 1 further comprising exchangeable output paper collecting trays positioned into the output discharging device;

locking means for lockingly engaging the output paper trays in the left side wall and in the right side wall.

6. A printer station comprising a printer frame of the printer station;

an output roller pair having a roller shaft and mounted to the printer frame;

a tiltable output discharging device for individual sheets or the like having a left side wall and a right side wall and rotatably supported at the printer frame of the printer station, and wherein the output discharging device includes a drivable friction roller pair with friction shafts and said output discharging device is disposed, if viewed in a direction of advance of printed individual sheets, after the output roller pair, where the friction roller shafts of the friction roller pair, in each case, are rotatably supported on the side walls of the tiltable output discharging device, and where the output discharging device is disposed outwardly directed and after the output roller pair if said disposing is viewed in the direction of advance of printed individual sheets;

further comprising a left bearing pin furnished at the left side wall;

a right bearing pin furnished at the right side wall, and wherein the left bearing pin and the right bearing pin form a first pivoting axis;

a left lever-like bearing rocker coordinated to the left side wall and including a left rocker opening;

a right lever-like bearing rocker coordinated to the right side wall and including a right rocker opening;

a floor piece forming part of the output discharging device such that the output discharging device includes the left side wall, the right side wall, and the floor piece jointed together, wherein the friction roller shafts, supporting the friction roller pair, are rotatably supported via the left lever-like bearing rocker and via the right lever-like bearing rocker, wherein one of the friction roller shafts are supported relative to the left side wall via a left bearing rocker shaft in the left rocker opening and via a right bearing rocker shaft in the right rocker;

a second pivoting axis, wherein the bearing rockers are rotatably supported around the second pivoting axis.

7. The printer station according to claim 6, wherein the first pivoting axis is spaced apart from the second pivoting axis by about 0.5 to 0.8 times the distance between the axes of the roller shafts from each other.

8. A printer station comprising a printer frame of the printer station;

output roller pair each having a roller shaft and mounted to the printer frame;

a tiltable output discharging device for individual sheets or the like having a left side wall and a right side wall and rotatably supported at the printer frame of the printer station, and wherein the output discharging device includes a drivable friction roller pair with friction shafts and said output discharging device is disposed, if viewed in a direction of advance of printed individual sheets, after the output roller pair, where the friction roller shafts of the friction roller pair, in each case, are rotatably supported on the side walls of the tiltable output discharging device, and where the output discharging device is disposed outwardly directed and after the output roller pair if said disposing is viewed in the direction of advance of printed individual sheets;

further comprising a catch gear wheel having counter locking teeth, wherein the catch gear wheel is rotatably attached on a first pivoting axis, and wherein the side walls are pivotable around the first pivoting axis;

a spring-supported catch having locking teeth for fixing a position and said spring-supported catch rotatably supported at the printer frame for furnishing different tilting positions of the output discharging device, wherein the locking teeth of the spring-supported catch are cooperating with the counter locking teeth of the catch gear wheel.

9. A printer station (1) with an output discharging device (3) for individual sheets (6), in particular for laser page printers, or the like, comprising left and right side wall and an output roller pair where the output discharging device (3) is disposed outwardly directed and following the output roller pairs (5) as seen in advance direction (7) of printed individual sheets (6), wherein the output discharging device (3) is rotatably supported at the printer frame (4) of the printer station (1), and the output discharging device (3) is furnished with a drivable friction roller pair (13), disposed, as seen in advance direction (7), following to the output roller pairs (5), where shafts (14, 15) of the friction roller pair (13), in each case, are rotatably supported on said side walls (8 and 9) of the tiltable output discharging device (3).

10. The printer station according to claim 9, wherein the shafts (14 and 15) of the friction roller pair (13) is connected to a gear wheel (19) on a shaft (21) of the output roller pairs (5) via a gear train (20).

11. The printer station according to claim 9, wherein the output discharging deive (3) is furnished with exchangeable output paper trays (10*a*), which output paper trays (10*a*) can be lockingly engaged in the side walls (8 and 9) by means of snap connections (27).

12. A printer station (1) comprising an output roller pair an output discharging device (3) for individual sheets (6), having right and left side walls in particular for laser page printers, or the like, where the output discharging device (3) is disposed outwardly directed and following said output roller pair (5) as seen in advance direction (7) of printed individual sheets (6), wherein the output discharging device (3) is rotatably supported at the printer frame (4) of the printer station (1), and the output discharging device (3) is furnished with a drivable friction roller pair (13), disposed, as seen in advance direction (7), following on the output roller pair (5), where shafts (14, 15) of the friction roller pair (13), in each case, are rotatably supported on said side walls (8 and 9) of the tiltable output discharging device (3);

wherein the output discharging device (3) includes a left side wall (8), a right side wall (9), and a floor piece (10), wherein bearing pins (11) are furnished at the side walls (8 and 9), wherein the bearing pins (11) form a first pivoting axis (12), wherein the shafts (14, 15) support the friction roller pair (13), and wherein the shafts (14, 15) are rotatably supported via lever-like bearing rockers (22, 23), said bearing rockers (22, 23) are connected to the side walls (8, 9), wherein one of the shafts (14 or 15), in each case, is supported in a respective side wall (8 or 9) via a bearing rocker shaft (24) in a rocker opening (25), and wherein the bearing rockers (22, 23) are rotatably supported around a second pivoting axis (26).

13. A printer station (1) comprising an output roller pair an output discharging device (3) for individual sheets (6), having right and left side walls in particular for laser page printers, or the like, where the output discharging device (3) is disposed outwardly directed and following said output roller pair (5) as seen in advance direction (7) of printed individual sheets (6), wherein the output discharging device (3) is rotatably supported at the printer frame (4) of the printer station (1), and the output discharging device (3) is furnished with a drivable friction roller pair (13), disposed, as seen in advance direction (7), following on the output roller pair (5), where shafts (14, 15) of the friction roller pair (13), in each case, are rotatably supported on said side walls (8 and 9) of the tiltable output discharging device (3);

further comprising a spring-supported catch (28) for fixing a position and rotatably supported at the printer frame (4) for furnishing different tilting positions of the output discharging device, a catch gear wheel (30) having counter locking teeth (30*a*) (3), wherein locking teeth (28) of the spring-supported catch (28) are cooperating with counter locking teeth (30) of a catch gear wheel (30), where said catch gear wheel (30) is rotatably attached on the first pivoting axis (12), around which pivoting axis (12) the side walls (8,9) are pivotable.

14. A collection method for sheet output comprising providing a tiltable output discharging device for individual sheets or the like, having a left side wall and a right side wall, an output roller pair, and said output discharging device being rotatably supported at the printer frame of the printer station in a desired position;

tilting said tiltable output discharging device;

providing a drivable friction roller pair on the output discharging device, said drivable friction roller pair having friction roller shafts;

gripping and rotatingly engaging the paper sheets further with said drivable friction roller pair;

positioning the friction shafts of the friction roller pair to be rotatably supported on the side walls of the output discharging device;

positioning the output discharging device directed outwardly and following the output roller pair as seen in advance direction of printed individual sheets, and;

discharging paper sheets with said output roller pair having a roller shaft and mounted to the printer frame of the printer station.

15. The collection method for sheet output according to claim 14 further comprising engaging a first gear wheel disposed on one of the roller shafts of the output friction roller pair with a driven gear train, wherein the friction roller shafts of the friction roller pairs are connected to the gear wheel on the roller shaft of the output roller pairs.

16. The collection method for sheet output according to claim 14 wherein a left bearing pin furnished at the left side wall;

a right bearing pin furnished at the right side wall and wherein the left bearing pin and the right bearing pin form a first pivoting axis;

a left lever-like bearing rocker connected to the left side wall and including a left opening for a link rod;

a right lever-like bearing rocker connected to the right side wall and including a right opening for a link rod;

a floor piece forming part of the output discharging device such that the output discharging device includes the left side wall, the right side wall, and the floor piece joined together, wherein the friction shafts, supporting the friction roller pair, are rotatably supported via the left lever-like bearing rocker and via the right lever-like bearing rocker, wherein one of the friction shafts is supported relative to the left side wall via the left bearing rocker shaft in the left opening and via the right bearing rocker shaft in the right opening, and further comprising tilting the bearing rockers around a second pivoting axis.

17. The collection method for sheet output according to claim 14 further comprising providing exchangeable output collecting trays positioning exchaneable output paper collecting trays into the output discharging device;

lockingly engaging the output paper trays in the left side providing locking means wall and in the right side wall with locking means.

18. The collection method for sheet output according to claim 14, further comprising pivoting the side walls around a first pivoting axis, wherein a catch gear wheel, having counter locking teeth, is rotatably attached on the first pivoting axis; fixing a position with a spring-supported catch, having locking teeth rotatably supported at the printer frame, for furnishing different tilting positions of the output discharging device, wherein the locking teeth of the spring-supported catch are cooperating with the counter locking teeth of a catch gear wheel.

19. A printer station comprising;

a printer frame;

an output roller pair supported on a pair of roller shafts and mounted to said printer frame;

a tiltable output discharging device for individual sheets having a left side wall and a right side wall and means for rotatably supporting said output discharging device to said printer frame;

said output discharging device includes a drivable friction roller pair supported on a pair of friction shafts disposed outwardly of said output roller pair relative to said printer frame;

said drivable friction roller pair being rotatably supported between said right side wall and said left side wall;

said means for rotatably supporting said output discharging device comprising a left bearing pin located at said left side wall and a right bearing pin located at said right side wall, a left lever-like bearing rocker attached to said left side wall and including a left opening for a bearing rocker shaft, a right lever-like bearing rocker attached to said right side wall and including a right opening for said bearing rocker shaft;

a floor piece joining said left side wall and side right side wall;

said friction roller pair being rotatably supported via said left lever-like bearing rocker and said right lever-like bearing rocker;

one of said friction shafts being supported relative to said left side wall via said left bearing rocker shaft in said left opening and relative to said right wall via said right bearing rocker shaft in said right opening.

20. The printer station according to claim 19, wherein the printer is a laser page printer.

21. The printer station according to claim 19, wherein the printer is a non-impact page printer.

22. The printer station according to claim 19 further comprising a first gear wheel disposed on the roller shaft of the output roller pair a gear train for engaging the first gear wheel, wherein the friction roller shafts of the friction roller pair are driven by the gear wheel connected to the roller shafts of the output roller pair.

23. The printer station according to claim 19, wherein the first pivoting axis is spaced apart from the second pivoting axis by about 0.5 to 0.8 times the distance between the axes of the roller shafts from each other.

24. The printer station according to claim 19 further comprising exchangeable output paper collecting trays positioned into the output discharging device; locking means for lockingly engaging the output paper trays in the left side wall and in the right side wall.

25. A printer station comprising;

a printer frame;

an output roller pair supported on a pair of roller shafts and mounted to said printer frame;

a tiltable output discharging device for individual sheets having a left side wall and a right side wall and means for rotatably supporting said output discharging device to said printer frame;

said output discharging device includes a drivable friction roller pair supported on a pair of friction shafts disposed outwardly of said output roller pair relative to said printer frame;

said drivable friction roller pair being rotatably supported between said right side wall and said left side wall;

said output discharging device being rotatable about a first pivoting axis;

a catch gear wheel having counter locking teeth;

said catch gear wheel being rotatably attached at said first pivoting axis;

said left and right side wall being pivotable around said first pivoting axis;

a spring-supported catch attached to said printer frame and having a locking tooth for fixing said output discharging device at various tilted positions;

said locking tooth of said spring-supported catch engaging with said counter locking teeth of said catch gear wheel.

* * * * *